US005136871A

United States Patent [19]

Lisec

[11] Patent Number: 5,136,871

[45] Date of Patent: Aug. 11, 1992

[54] PROCESS AND APPARATUS FOR BENDING HOLLOW PROFILE STRIPS INTO SPACER FRAMES FOR INSULATING GLASS PANES

[76] Inventor: Peter Lisec, Bahnhofstrasse 34, A-3363 Amstetten-Hausmening, Austria

[21] Appl. No.: 704,975

[22] Filed: May 23, 1991

[30] Foreign Application Priority Data

Jun. 7, 1990 [AT] Austria ..... 1247/90
Sep. 10, 1990 [AT] Austria ..... 1840/90

[51] Int. Cl.[5] ..... B21D 43/28

[52] U.S. Cl. ..... 72/294; 72/307; 72/422; 72/296

[58] Field of Search ..... 72/294, 295, 296, 311, 72/129, 166, 422, 307, 319, 320, 304, 323, 322, 306, 386, 387, 388, 391.2; 414/750, 751; 901/6; 83/277

[56] References Cited

U.S. PATENT DOCUMENTS

| | | | |
|---|---|---|---|
| 2,343,441 | 3/1944 | Babcock et al. | 72/319 |
| 2,353,405 | 7/1944 | King | 83/277 |
| 3,983,735 | 10/1976 | Berry | 72/312 |
| 3,994,152 | 11/1976 | Wolters | 72/319 |
| 4,360,724 | 11/1982 | Ritter et al. | 414/751 |
| 4,462,237 | 7/1984 | Kauferle et al. | 72/324 |
| 4,524,656 | 6/1985 | Del Fabro et al. | 83/277 |
| 4,561,279 | 12/1985 | Weurs | 72/294 |
| 4,590,779 | 5/1986 | Stange et al. | 72/294 |
| 4,779,436 | 10/1988 | Schwarze | 72/307 |
| 4,836,005 | 6/1989 | Lisec | 72/306 |

FOREIGN PATENT DOCUMENTS

| | | | |
|---|---|---|---|
| 360311 | 1/1981 | Austria . | |
| 0318748 | 6/1989 | European Pat. Off. . | |
| 0318749 | 6/1989 | European Pat. Off. . | |
| 0249946 | 2/1990 | European Pat. Off. . | |
| 2128717 | 8/1973 | Fed. Rep. of Germany . | |
| 3221986 | 12/1983 | Fed. Rep. of Germany . | |
| 3223881 | 9/1985 | Fed. Rep. of Germany . | |
| 8705796 | 7/1987 | Fed. Rep. of Germany . | |
| 3627152 | 12/1987 | Fed. Rep. of Germany . | |
| 9015527 | 3/1991 | Fed. Rep. of Germany . | |
| 2428728 | 1/1980 | France . | |
| 0023786 | 6/1977 | Japan | 72/319 |
| 0046785 | 12/1978 | Japan | 72/319 |
| 652324 | 11/1985 | Switzerland . | |

*Primary Examiner*—Lowell A. Larson
*Assistant Examiner*—Michael J. McKeon
*Attorney, Agent, or Firm*—Young & Thompson

[57] ABSTRACT

During the bending of a hollow profile strip (53) into a spacer frame for insulating glass panes, the hollow profile strip (53) is advanced, by a gripper (52) displaceable in the feeding direction of the hollow profile strip (53) by predetermined distances, to such an extent that the location of the hollow profile strip (53) to be bent in a particular case is aligned with respect to a bending abutment (20). During the bending processes, performed with a bending lever (62), the hollow profile strip (53) is retained by the jaws (3, 4) of the bending head, and the gripper (52) moves back into its starting position. After the final advancement of the hollow profile strip (53), the latter is severed from the introduced hollow profile strip (53) and only then is the final bending step executed. The hollow profile strip (53) is constantly retained during the production of the spacer frame, either by the gripper (52) or by the jaws (3, 4) of the bending head.

27 Claims, 7 Drawing Sheets

PROCESS AND APPARATUS FOR BENDING HOLLOW PROFILE STRIPS INTO SPACER FRAMES FOR INSULATING GLASS PANES

The invention relates to a process for bending hollow profile strips into spacer frames for insulating glass panes wherein the hollow profile strip is moved stepwise to a bending station and bent after each feeding step.

Devices for bending hollow profile strips into spacer frames have been known, for example, from German Utility Model 8,705,796.4 or DOS 3,221,986. In these conventional devices, the length of the profile rod (hollow profile strip) projecting beyond the bending site must be determined in order to obtain the spacer frame with the desired dimensions.

The known bending devices for producing a spacer frame for insulating glass panes determine the length of the profile rod by path measurement via incremental generators.

Normally, the hollow profile strip is moved by conveying rollers in contact with the strip on both sides, at least one of these rollers being driven. A track wheel (generator wheel) travels along the outer wall of the thus-transported hollow profile strip, this wheel being in force-derived connection with an incremental generator by way of the axle or some other drive mechanism.

The generator wheel rolling along the outre wall of the hollow profile strip detects the advancement of the hollow profile strip.

One disadvantage in these devices is to be seen in that the frictional contact between the generator wheel and the hollow profile strip is non-uniform and consequently results in a greater or lesser extent of slippage. Surface sections of the hollow profile strip of a different nature which can be smooth, rough, or also can carry residues, such as dust or metal filings, cause erroneous measurements by the incremental generator, especially also in case the hollow profile strip is arrested during the measuring movement or is only moved toward the generator wheel.

Also conventional are devices for bending hollow profile strips, especially for bending hollow profile strips into spacer frames for insulating glass panes with two jaws which can be brought into contact with the lateral surfaces of the hollow profile strip to be bent, an abutment around which the hollow profile strip is bent, and a bending lever pivotable with respect to the abutment for performing the bending operation.

Such bending devices which, in part, are to yield maximally sharp-edged bends of the hollow profile strips are known in various designs. Attention is invited, for example, to German Patent 3,223,881, German Utility Model 8,705,796 or U.S. Pat. No. 4,836,005.

Moreover, spacer frames produced in one piece with bent corners, as well as devices for producing these spacer frames, have been known from French Patent 2,449,222 and DOS 3,221,986. Also, attention is invited to DOS 3,312,764 from which it is known to bend hollow profile strips into spacer frames for insulating glass panes wherein a mandrel is provided in the region of the bending site which can be brought into contact with the hollow profile strip from the inside. Bending takes place by the pivoting of a jaw, the other end of the profile strip being clamped in place between a movable clamping jaw and an abutment in contact from the inside of the profile strip.

One problem in the known bending devices resides in that the sharp-edged bends in the region of the corners of the spacer frame required for use in insulating glass panes cannot always be obtained without difficulties inasmuch as there is the danger, in part, that the walls of the hollow profile strip will develop tears during the bending step, and the lateral surfaces of the hollow profile strips do not always extend in planar fashion in the corner zone, i.e. at the location where they have been bent, but rather exhibit undulations which interfere with and impede the subsequent processing of the spacer frame, especially the coating of the lateral surfaces thereof with sealing compound or adhesive.

DAS 2,128,717 discloses a process for the application of a metallic spacer to the pane rims of one of the rectangular glass plates of an insulating glazing wherein the spacer, as a continuous strip, is brought into contact with a pane-parallel surface of a first pane rim of the horizontally lying glass plate and is then attached to this surface, and the continuous spacer is also brought into contact with a pane-parallel surface of the subsequent pane rim and then is attached to this surface whereupon the sequence of the preceding operating steps is repeated with the following pane rims whereafter the spacer is cut off and its ends are joined. In this procedure, the glass pane, after attaching the spacer to a pane rim, but before it is pivoted, is shifted in parallel to this pane rim, by a distance corresponding to the length of this pane rim. The pivoting of the glass plate takes place in each case about a fixedly determined pivot axis, the spacer also being bent about this pivot axis. In this process, the spacer is initially arranged only along a portion of the length of the first pane rim, and the spacer, after it has been attached to the pane-parallel surface of the last pane rim, is cut off with an excess length. Only then is the excess portion bent by 90° about the pivot axis of the glass pane and attached to the glass pane.

Austrian Patent 360,311 discloses the bending of spacer frames from a hollow profile strip cut to the required length. There is no suggestion in Austrian Patent 360,311 to cut off the hollow profile strip only after the bending of three corners of the spacer frame to be manufactured, severing the frame from the hollow profile strip fed to the device.

EP-A-318,748 describes a bending apparatus wherein reference is had primarily to the structure of a bending tool.

The clamping device for seizing the section of the hollow profile strip located in front of the bending zone cannot be moved, in EP-A-318,748, in the feeding direction of the hollow profile strip. Therefore, this clamping device does not serve for conveying the hollow profile strip, either. EP-A-318,748 lacks any mention of special measures or devices for advancing the hollow profile strip between the bending procedures, and there is no disclosure, either, of the step of severing the hollow profile strip from the introduced hollow profile strip only after the third bending step.

The bending apparatus described in EP-B-249,946 produces in each case two corners simultaneously by bending from a hollow profile strip which latter has been cut to size previously.

EP-B-249,946 makes it conventional, per se, to deflect the ends of the hollow profile strip out of the bending plane. However, the bending process of EP-B-249,946 deviates from the process discussed hereinabove in that, in the latter, two corners are not in each case produced simultaneously.

It is an object of the invention to provide a process wherein, during transport of the hollow profile strip into a bending device, the length of the feed of the hollow profile strip can be measured accurately and without tolerances.

This object has been attained, in a process of the type discussed above, by providing that the hollow profile strip is advanced by a feeding device clamping the hollow profile strip into place; that the hollow profile strip prior to the bending step is retained in the zone of the bend to be produced in the bending station; that the hollow profile strip is then bent; that the hollow profile strip prior to bending of the final corner is severed from the introduced hollow profile strip after it has been advanced for the last time; and that then the final corner is bent and the thus-produced spacer frame is transported away.

In the process according to this invention, the hollow profile strip to be bent into the spacer frame is advanced by the gripper prior to each bending step exactly by the required distance which corresponds, for example, to the respective leg of the spacer frame. In case the length of the leg is larger than the maximum stroke of the gripper, the profile strip is advanced in two or, if need be, more than two steps. The procedure can be such that the first stroke or the initial strokes correspond to a predetermined length (for example to the maximum stroke) of the feeding device, and the final stroke is adapted to be the required length of the frame leg.

If, when performing the process of this invention, the operation is such that, during bending of the final corner, the previously bent section of the hollow profile strip and/or the forward end of the introduced hollow profile strip is deflected from the bending plane, then neither the introduced hollow profile strip nor the section of the hollow profile strip bent into the spacer frame that is located at the bending site will interfere with the bending of the final corner.

In a practical embodiment of the invention, the procedure can be that the advancement of the hollow profile strip prior to bending the first corner is smaller by a predetermined increment than the dimension of the spacer frame to be manufacture as measured in this direction, and that the hollow profile strip, prior to the final bending step, is severed from the introduced hollow profile strip at a spacing from the bending site which corresponds to the length of the predetermined increment. If the operation is carried out in this way, then the hollow profile strip can be securely retained during the bending of the final corner.

Ordinarily, the process will be executed so that the bent sections of the hollow profile strip are disposed on a supporting surface.

The advancing operation becomes more accurate if the hollow profile strip is retained in the region of the bending site during the movement of the feeding device into its starting position.

The invention also concerns an apparatus for performing the process according to this invention, with a device for feeding the hollow profile strip to be bent into the spacer frame, with a supporting surface for the bent sections of the hollow profile strip, and with a bending head. This apparatus can be characterized, according to the invention, by exhibiting, for feeding the hollow profile strip, a gripper which can be brought into contact with the hollow profile strip during the advancement of the hollow profile strip, and by providing that the bending head comprises jaws that can be brought into contact with the hollow profile strip, for retaining the hollow profile strip during the bending operations, the gripper and the jaws engaging the hollow profile strip alternatingly.

In a practical embodiment of the invention the apparatus includes a clamp for the hollow profile strip which, for varying the mutual spacing, exhibits clamping jaws that can be moved relatively to each other and can be made to contact the lateral surfaces of the hollow profile strip to be bent, wherein a support for the hollow profile strip to be bent is arranged between the clamping jaws, with an abutment associated with the clamp about which the hollow profile strip is bent and which is in contact, during the bending step, with the surface of the hollow profile strip that subsequently forms the inner corner, and with a bending lever pivotable with respect to the clamp for performing the bending step, which lever can be brought into contact with the section of the hollow profile strip projecting beyond the clamp, and the provision is made in accordance with the invention that the abutment is retained on a support which can be adjusted in as well as in parallel to the plane of symmetry of the clamp and also perpendicularly to this plane of symmetry for moving the abutment out of the bending plane.

Additional details and features of the apparatus and of the process according to the invention and advantages obtained thereby can be seen from the following description of embodiments illustrated in the drawings wherein.

Figure 10:
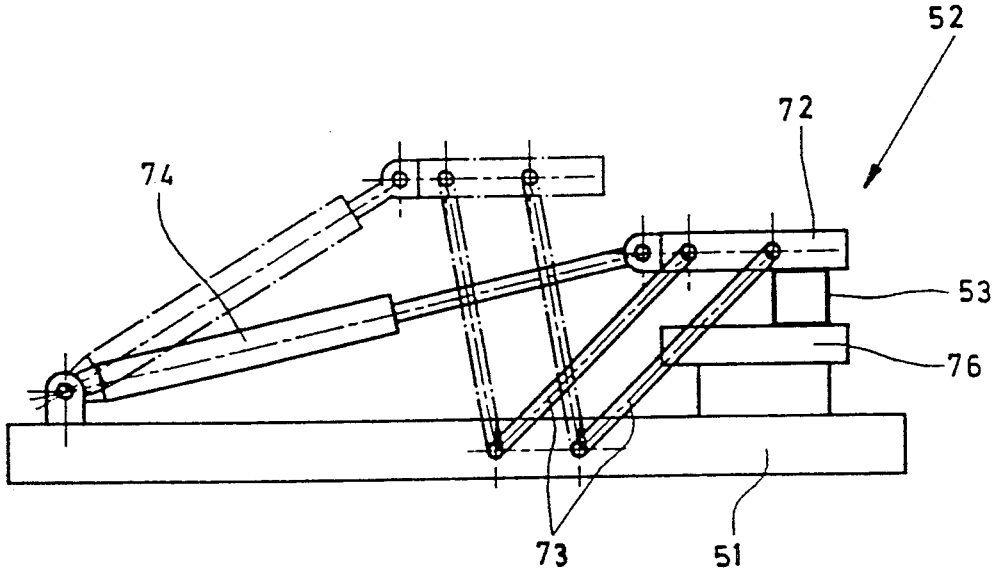

FIGS. *9a–9f* are sequential schematic view of individual stages of the process according to this invention; and FIG. 10 shows a preferred embodiment of a gripper for the feeding of hollow profile strips.

A hollow profile strip 53 is transported on a conveyor route 54 arranged at the bottom end of a supporting wall 60 up to a stop 57 in the zone of a bending station with a bending abutment 58 and a bending lever 59.

The section 53' of the hollow profile strip 53, transported past the bending station 58/59—as will be described further below—is bent while in contact with the supporting wall 60 by the bending lever 59 about an abutment 58. The bending station preferably has the structure described below with reference to FIGS. 3 through 8.

Otherwise, the apparatus can have the construction known, for example, from German Utility Model 8,705,796 and can include a supporting finger (FIG. 9) as also provided in the known apparatus.

Figure 3:
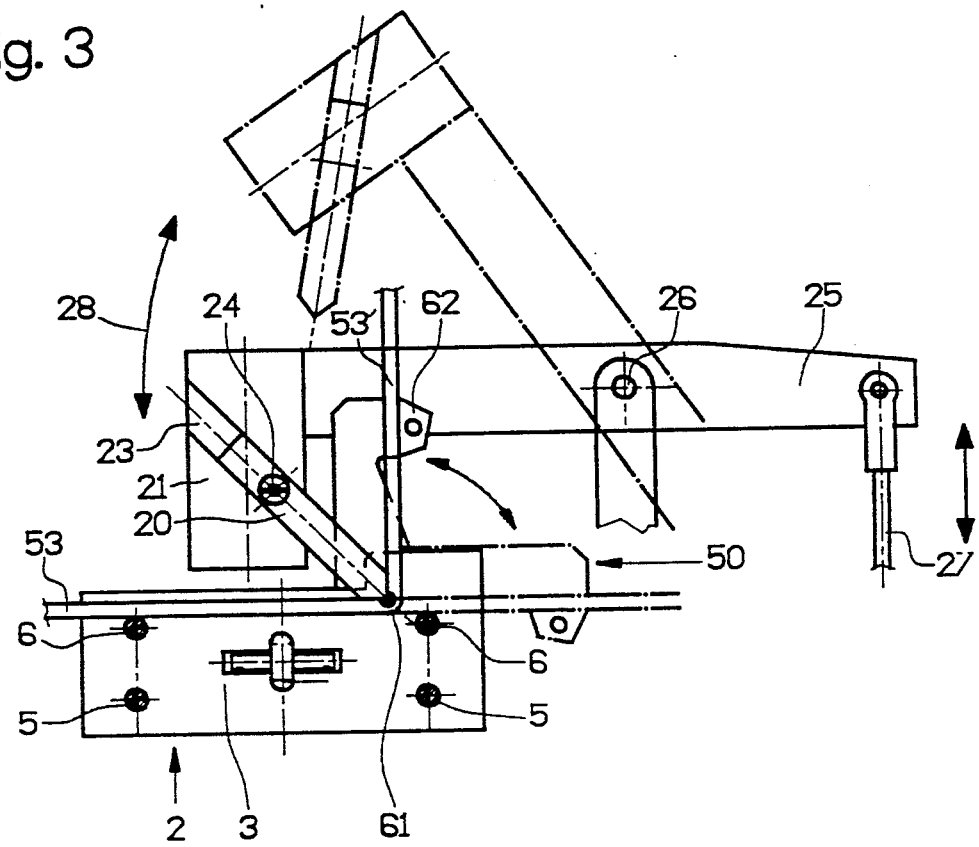
FIG. 3 shows a bending head in a lateral view.

The apparatus for bending hollow profile strips 53 illustrated in FIGS. 3–8 consists of a clamp 2 with a fixed clamping jaw 3 and a clamping jaw 4 movable with respect to the former jaw (FIG. 3 does not show the clamping jaw 4). The movable clamping jaw 4 can be displaced by way of guide pins 5 and 6, each of which are arranged in pairs, in the direction of double arrow 7, so that the opening width of the camp 2 can be adapted to the breadth of the hollow profile strip 53 to be bent.

Figure 4:
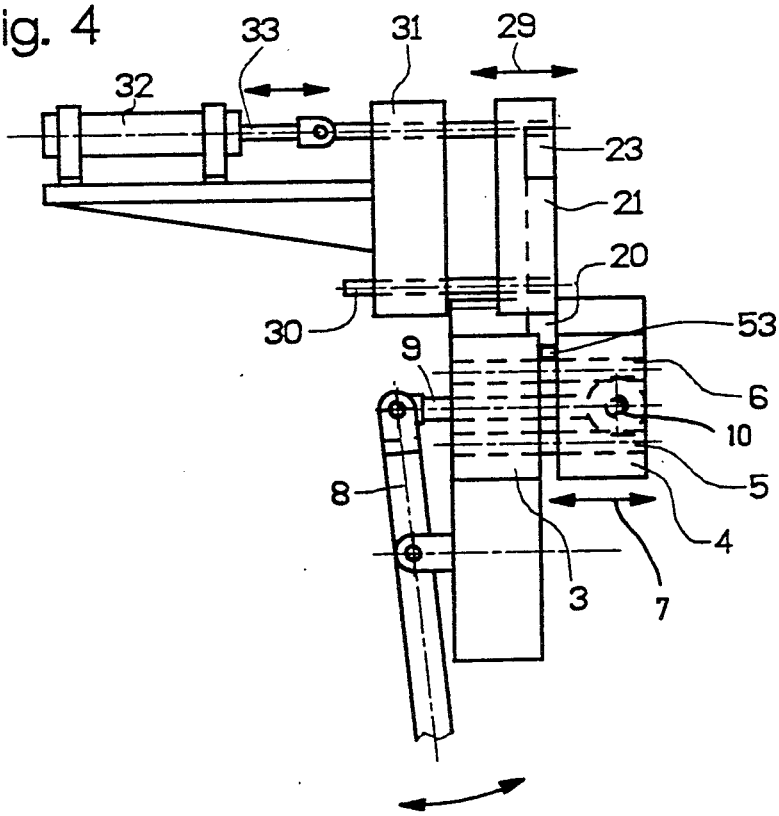
FIG. 4 shows a bending head as seen from the left-hand side of FIG. 3.
Figure 5:
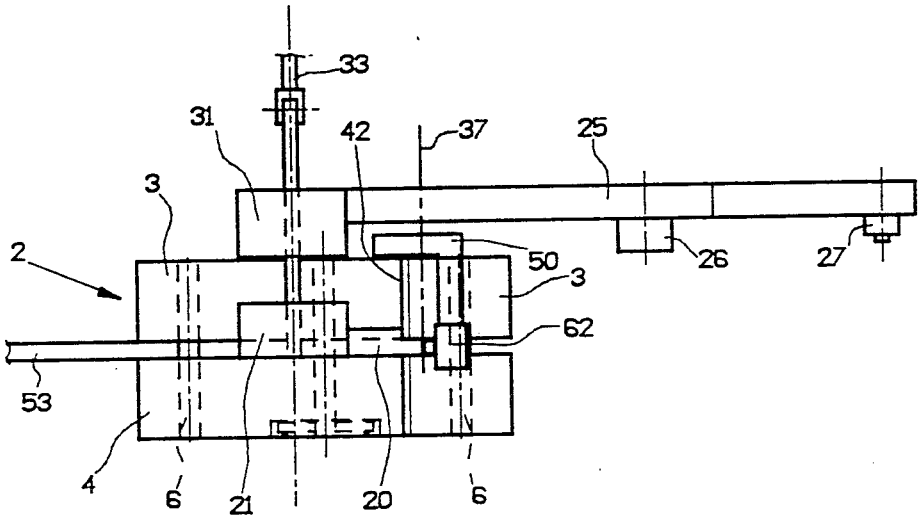
FIG. 5 shows a top view of the bending head.

A lever 8, pivotably supported at the fixed clamping jaw 3, is provided for operating the movable clamping jaw 4 in the direction of arrow 7 (FIG. 4). The lever 8 is coupled to the movable clamping jaw 4 via a tie rod 9 which is supported in a bearing 10 in a pivotably movable fashion at the movable clamping jaw 4. The pivot lever 8 is operated by means of a linear motor, not shown, for example a dual-acting pressure medium cylinder.

Figure 1:
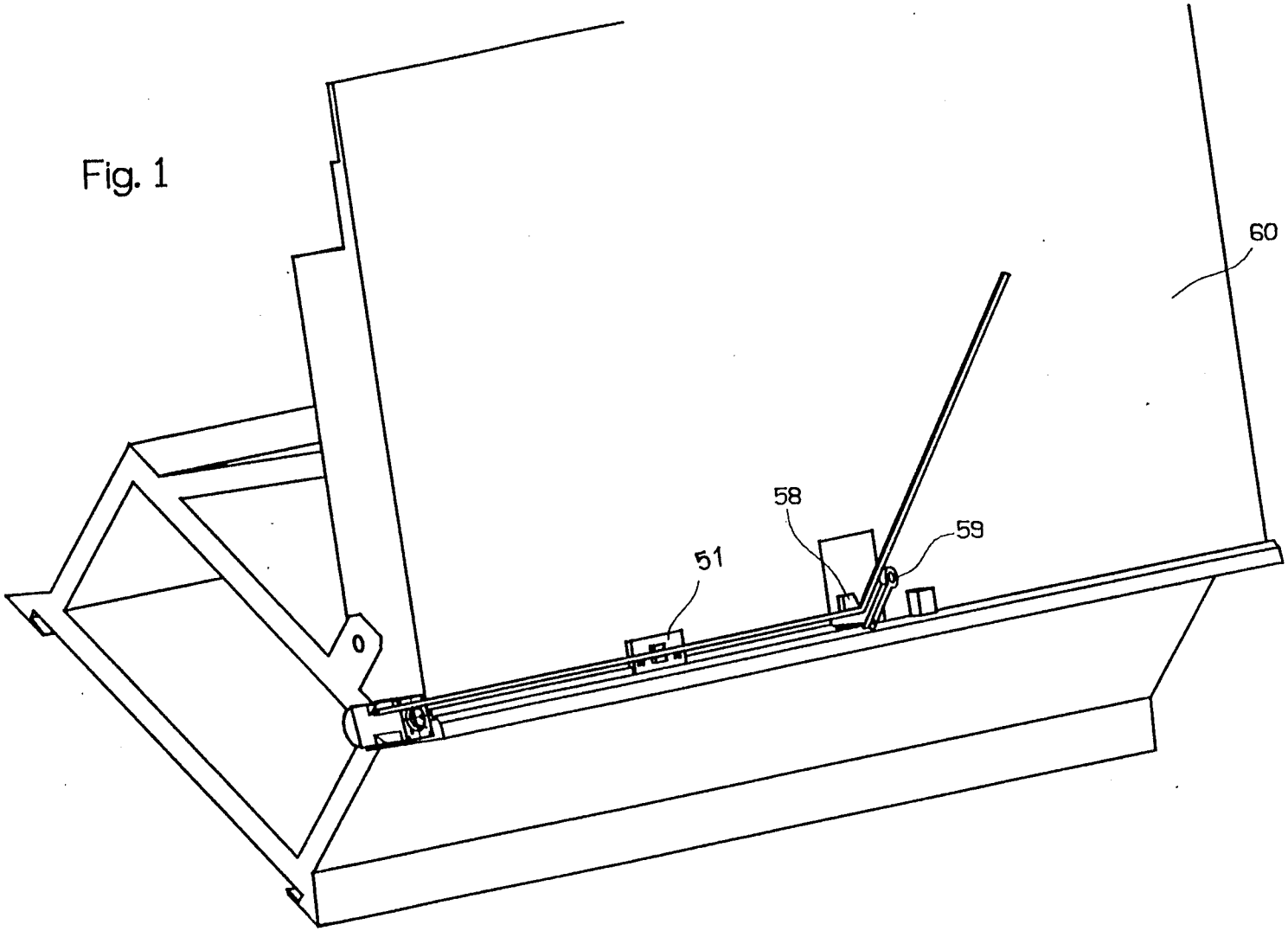
FIG. 1 shows an apparatus for bending hollow profile strips into spacer frames.
Figure 2:
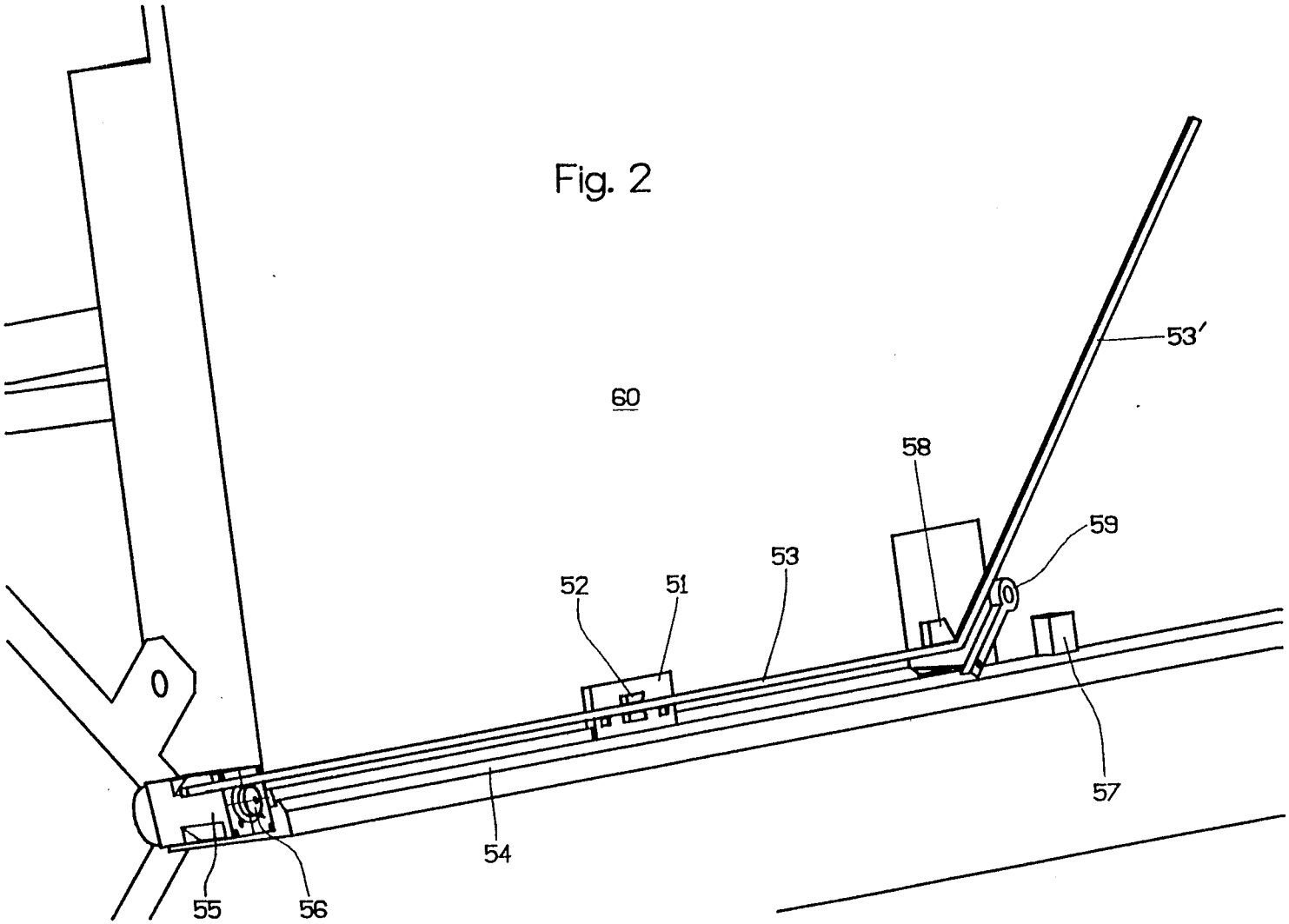
FIG. 2 shows the apparatus of FIG. 1 on an enlarged scale.

The bending apparatus furthermore includes an abutment 20 corresponding to the bending abutment 58 in FIGS. 1 and 2 which is exchangeably inserted in a support 21. For this purpose, a groove 23 is recessed in the support 21; the abutment 20 can be inserted in this groove with a sliding fit and is retained therein by a screw 24, for example.

The support 21 for the abutment 20 is mounted to a lever 25. The lever 25 is pivotable about a bearing 26 affixed to the machine frame, i.e. a bearing immovable with respect to the fixed clamping jaw 3 of the clamp 2, in the direction of double arrow 28 from the operative position illustrated in solid lines in FIG. 3 into the ready position shown in dot-dash lines in FIG. 3, with the aid of a linear motor 27, for example a dual-acting pressure medium cylinder.

In addition, the support 21 for the abutment 20 is adjustable perpendicularly to the plane of symmetry of the clamp 2, as shown in FIG. 4, namely in the direction of double arrow 29 illustrated in FIG. 4. For this purpose, the support 21 is displaceably guided via guide means 30 in a holder 31 connected with the lever 25. A linear motor, in the illustrated embodiment a dual-acting pressure medium motor 32, is provided for adjusting the support 21 and thus the abutment 20 in the direction of double arrow 29; the piston rod 23 of this motor is coupled with the support 21 by way of a tie rod 34.

In this way, the abutment 20 can not only be swung in a plane in parallel to the plane of symmetry of the clamping jaw 2 (double arrow 28), but can also be adjusted in a direction perpendicular to the plane of symmetry of the camp 2 (double arrow 29) so that the abutment 20 can be moved in its entirety out of the range of the clamp.

Figure 6:
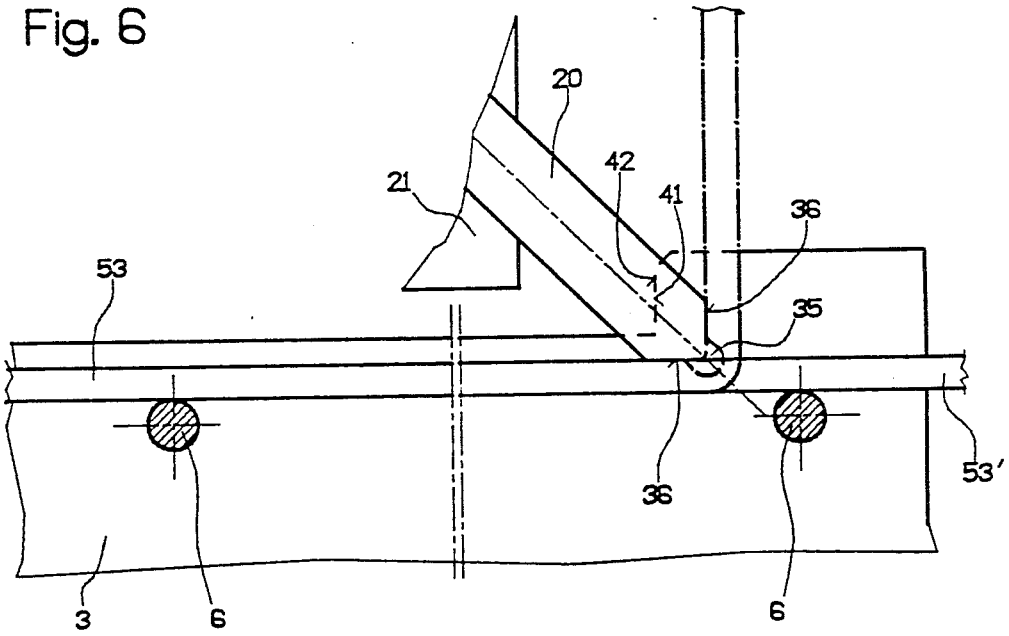
FIG. 6 shows a detail of the bending head in the zone of the bending abutment.
Figure 7:
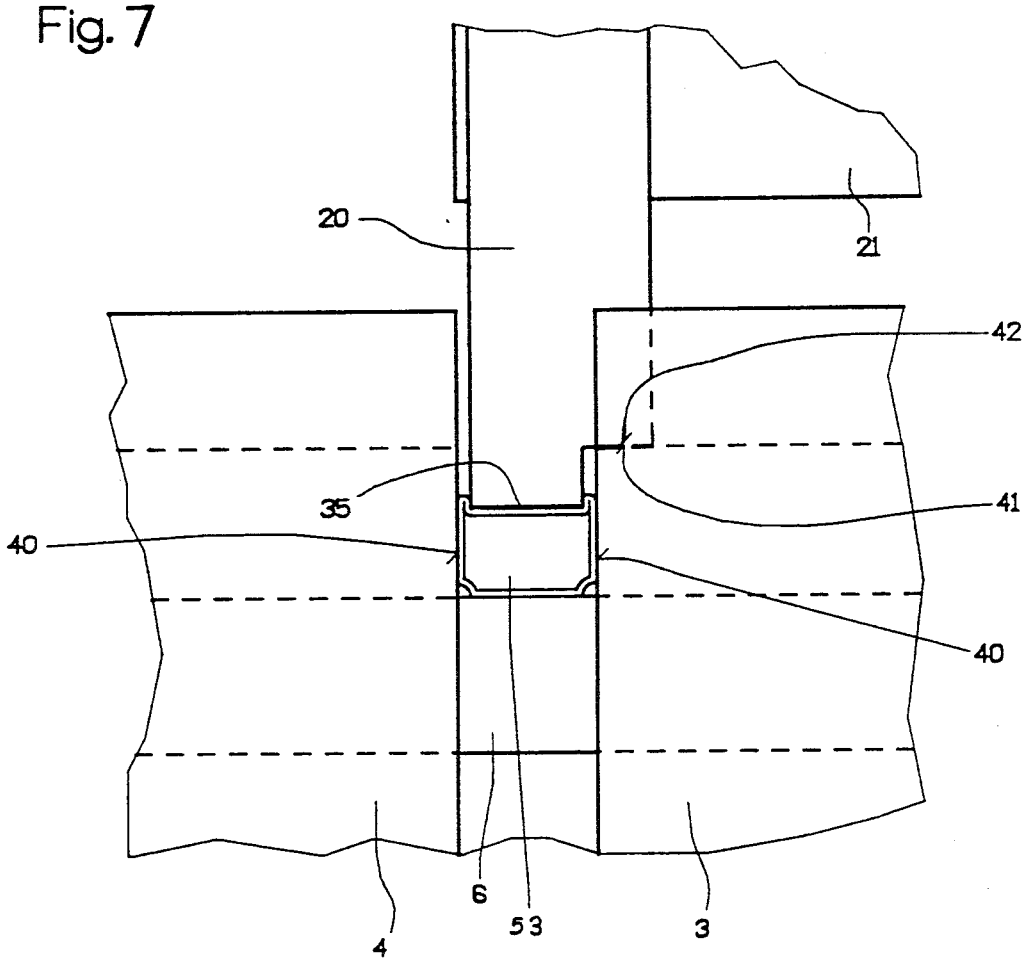
FIG. 7 shows a further detail of the bending head, in the zone of the bending abutment.
Figure 8:
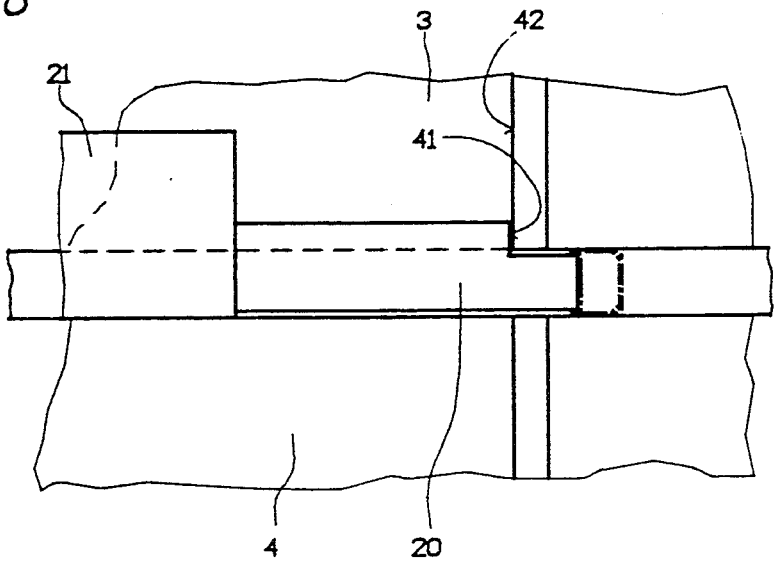
FIG. 8 shows an enlarged detail in the zone of the bending abutment.

As shown in FIG. 6, the abutment 20 carries at its front tip, formed by two inclined surfaces 36 producing an acute angle to the longitudinal extension of the bending abutment 20, a bead-like extension 35 which, as shown in FIG. 6, somewhat curves the upper surface of the hollow profile strip 53 clamped in the clamp 2 between the clamping jaws 3 and 4, still prior to the onset of the bending operation, i.e. when the bending abutment 20 pivots into its operative position.

In addition, the provision is made in the bending apparatus of this invention that the forward end of the abutment 20 and the bead-like extension 35 adjoining the oblique surfaces 36 at that location are fashioned to be somewhat narrower than the inside spacing between the mutually facing surfaces of the clamping jaws 3 and 4 of the clamp 2. Thus, the sidewalls 40 of the hollow profile strip 53 to be bent are also supported from the inside during the bending operation, as indicated in the sectional view of FIG. 7. This is of importance, in particular, when bending hollow profile strips 53 into spacer frames for insulating glass panes since the width of the lateral surfaces 40 of the hollow profile strip 53 is not to be reduced at all, if possible, even in the corner zone, and these lateral surfaces 40, in the corner zone, are not to deviate toward the inside from the planes defined by the lateral surfaces 40 in the zone of the corner so that it is possible to apply the adhesive and caulking material, e.g. a butyl rubber, to be provided prior to assembly of the insulating glass panes on the spacer frames in the zone of their lateral surfaces 40, over the full width also in the corner zone which is of considerable importance for the leakproofness of insulating glass panes.

In order to correctly align the abutment 20, especially its bead-like extension 35, with respect to the clamping jaw 2 and thus with respect to the axis 37 about which the hollow profile strip 53 is bent, an angled stop surface 41 is provided at the abutment 20 in the zone of its forward end on one side; this stop surface cooperates with a step 42 on the fixed clamping jaw 3. Once the stop surface 41 is in contact with the step 42 of the clamping jaw 3, the axis 37 of the bead-like extension 35, provided at the front end of the bending abutment 20, is correctly aligned.

The apparatus according to this invention for performing a bending operation further includes a bending lever 50 with a bending extension 62 pivotable about an axis congruent with the axis 37 of the bead 35 at the front end of the bending tool 20 when the abutment 20 is in its operative position (the surfaces 41 are in contact with the surfaces 42 of the clamping jaw 3). The pivoting range of the bending lever 50 is not restricted to the 90. illustrated in FIG. 3 but rather also exceeds this value so that after the pivoting step (arrow 28) and the lateral displacement (arrow 29) of the bending abutment 20, it is even possible to make a bend with acute angles between the two legs of the hollow profile strip 53 adjoining the corner 61 produced in the hollow profile strip 53.

For bending a hollow profile strip 53 into a corner, the clamp 2 is opened and the hollow profile strip 53 is placed on the upper guide pin 6 or is transported from the conveyor route 54 onto the guide pins 6. After the clamp 2 has been closed, with the inner surfaces of the clamping jaws 3 and 4 then being in contact with the lateral surfaces 40 of the hollow profile strip 53, the abutment 20 is moved into its operative position shown in FIGS. 3 and 6 and, during this step, produces a certain downward curve in the upwardly pointing wall of the hollow profile strip 53. Thereupon, the section 53' of the hollow profile strip 53 projecting out of the clamp 2 is pivoted by swinging the bending lever 50, with the formation of a corner 61. If the angle at the corner 61 is to be an acute one, the abutment 20 is pivoted back and laterally retracted whereupon bending is continued to the desired angle.

Thereupon, the bending lever 50 is pivoted back, the clamp 2 is opened, and the hollow profile strip 53 is advanced until the location of the hollow profile strip 53 where the next corner 61 is to be produced is correctly aligned with respect to the bending tool. Then, as described above, the subsequent corner 61 is bent into shape. This procedure is continued until a spacer frame having the desired number of corners 61—in most cases four—has been created by bending.

The apparatus shown in FIGS. 1 and 2 operates, subject to the description of the process of this invention with reference to FIG. 9, as follows:

The hollow profile strip 53 transported by the conveyor route 54 at the lower rim of the supporting wall 60 travels to the end stop 57. The hollow profile strip 53 is thus in a "zero" position almost free of tolerance. At this time, the jaws of grippers 52 mounted on the slide 51 seize the hollow profile strip 53 in this position. The stop 57 is lowered below the conveyor route 54, and the slide 51 with the hollow profile strip 53 clamped in place via the gripper 52 moves then in the direction of the bending lever 59 exactly by that path increment predetermined by a process computer and corresponding to the length of a leg of the spacer frame to be produced and measured by an incremental generator 56. Once the slide 51 has reached the end point as predetermined and effectively measured, the bending lever 59 bends the section 53' of the hollow profile strip 53 projecting past the slide 51 along the rearwardly inclined supporting wall 60 upwardly by the angle predetermined by a process computer—usually 90°.

An incremental generator 56 determines the exact measurement of the path length traversed by the slide 51, and/or regulates this path length. The incremental generator 56 is mounted to the drive motor 55 or at a point of the moving route of the slide 51.

The slide 51 is driven, for example, by an endless toothed belt and is guided on a guide means extending in parallel to the conveyor route 54.

The engagement of the toothed belt into the drive gear wheel of the geared motor 55 is exact and without play so that even an incremental generator 56 mounted directly to the motor-gear unit can accurately record the traversed path length of the slide 51. The distance the slide 51 is to travel effectively corresponds to the profile length determined by the process computer for a bending operation.

The use of a toothed rack mounted to the guide means of the slide 51 is also advantageous for driving slide 51. In this alternatively usable device, the drive motor 55 need not be fixedly mounted to the bending table 60 but rather can also be arranged at the slide 51. The drive gear wheel of the drive motor 55 then engages into the toothed rack attached at the guide means; in this arrangement, an incremental generator 56 can likewise be mounted to the drive motor 55 or to the slide 51.

While the bending lever 59 bends the section 53' of the hollow profile strip 53 upwards and the profile strip is held by the jaws 3 and 4, the gripper 52 mounted to the slide 51 is released from the hollow profile strip 53. The slide 521 then travels at a high speed back into the starting position (reference point). Then the gripper 52 again frictionally seizes the hollow profile strip 53. The slide 51, after the bending step, again advances in the direction of bending lever 59 exactly by the path length predetermined by the process computer.

In case the hollow profile strip 53 is fed into the apparatus by a feeding device connected in front thereof up to the stop 57, the conveyor route 54 can be a simple slideway.

The gripper 52 is mounted to the movable slide 51 which latter is driven without slippage by the motor 55; the gripper seizes the hollow profile strip 5 with frictional contact from the side or from the top and bottom. The unit of slide 51 and gripper 52 transports the hollow profile strip 53 without slippage in the direction of bending lever 59. An incremental generator 56 mounted to the drive motor 55 or to the conveyor slide 51 engages into a toothed conveyor belt or into a rack and determines the effectively traversed length of the slide 51 predetermined by a process computer.

The sequence of operating steps when performing the process of this invention will be described hereinbelow with reference to FIG. *9a–9f* in additional details, using as an example the manufacture of a rectangular spacer frame:

A hollow profile strip 53 is advanced by a conveying means which can be, for example, the slide 51 with the gripper 52, starting, for example, with the reference position determined by the stop 57, to such an extent that the section 53' of the hollow profile strip 53 projecting past the bending abutment 20 corresponds to the length of the first leg of the spacer frame to be manufactured, diminished by a specific distance "x". This position is shown in FIG. *9b*.

At this point, the jaws 3 and 4 come into lateral contact with the hollow profile strip 53, and the slide 51 returns into its starting position illustrated in FIG. *9a*. After this return movement of the slide 51 is completed, or still during this movement, the section 53' is bent by the bending lever 50 in the upward direction about the bending abutment 20 in the direction of the arrow in FIG. *9b*.

Once the bending step is done, the hollow profile strip 53 is released by the jaws 3 and 4, and the slide 51 advances into the position shown in FIG. *9c*, with the gripper 52 being in engagement from both sides (or from the top and bottom) with the hollow profile strip 53, the gripper advancing the hollow profile strip 53 to such an extent that the site wherein the next (second) corner is to be produced by bending in the hollow profile strip 53 is aligned with respect to the bending abutment 20.

Now the jaws 3 and 4 are closed again and retain the hollow profile strip 53 fixedly without displacement, and the next (second) bending step is executed with the aid of the bending lever 50 while the slide 51 again returns into its starting position.

After the second bending step is completed, the slide 51 moves forward, with the gripper 52 being in contact with the hollow profile strip 53, by a distance corresponding to the length of the subsequent leg of the spacer frame to be manufactured so that the site of the hollow profile strip 53 wherein the subsequent (third) corner is to be produced is aligned with respect to the bending abutment 20. The clamping jaws 3 and 4 close again and retain the hollow profile strip 53 whereupon the third bending step is performed.

After the third bending step is finished, the jaws 3 and 4 are again released from the hollow profile strip 53, and the slide 51 moves again in the forward direction, with the gripper 52 in contact with the hollow profile strip 53, to such an extent that the next (fourth) site of the hollow profile strip 53 wherein a corner is to be bent is exactly aligned with respect to the abutment 20.

Figure 9A:
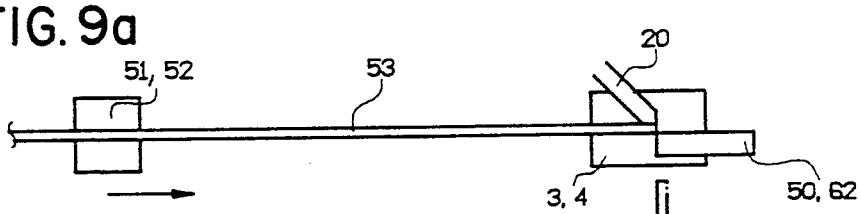
Figure 9B:
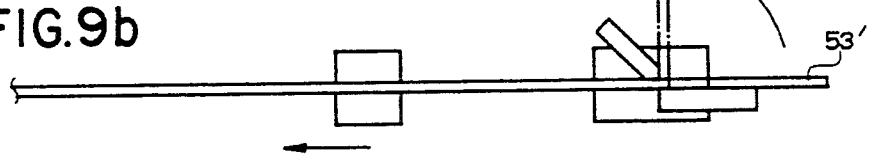
Figure 9C:
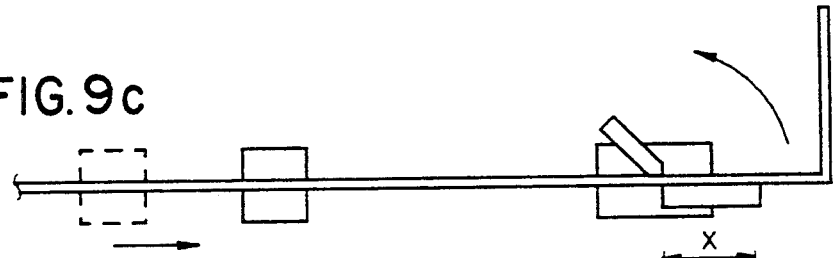
Figure 9D:
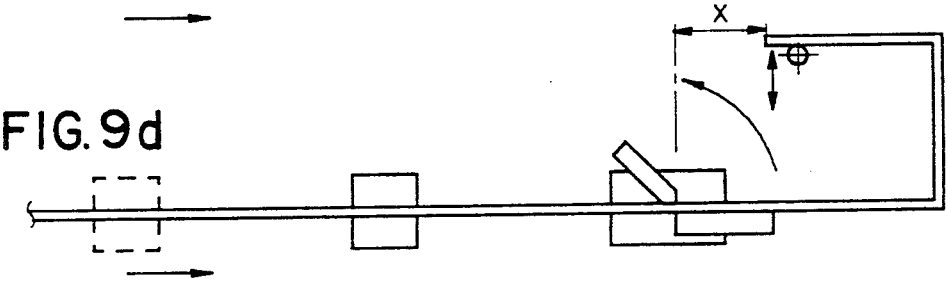
Figure 9E:
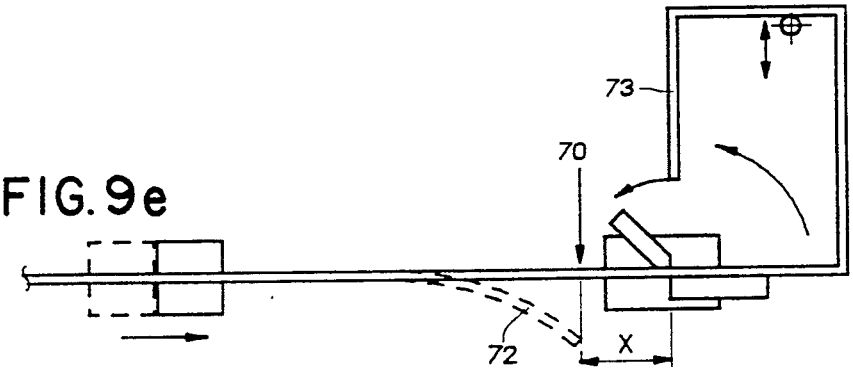
Figure 9F:
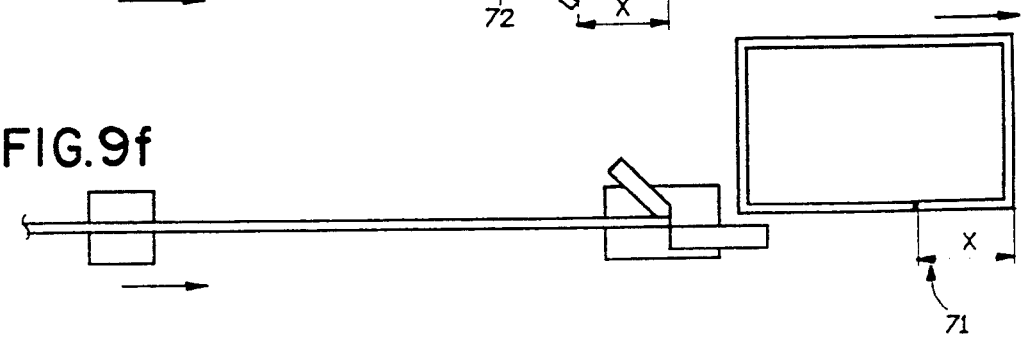

When manufacturing a rectangular spacer frame as illustrated in FIG. *9a–9f*, this stroke corresponds exactly to the stroke prior to execution of the second bending step. After the advancement of the hollow profile strip 53 has been accomplished as described above and the next bending site (the fourth) has been aligned with respect to the abutment 20, the jaws 3 and 4 are closed again and retain the hollow profile strip 53. Now the hollow profile strip 53 is cut off at the location denoted by arrow 70 (FIG. 9*e*). The length of the thus-obtained section of the hollow profile strip 53, located to the left of the bending abutment 20 in FIG. 9*e*, corresponds exactly to the predetermined distance "x" by which the hollow profile strip 53 had been advanced less far than corresponds to the length of the first leg (FIG. 9*b*) prior to the first bending step (FIG. 9*b*).

At this point the fourth bending step is performed; the front end 72 of the thus-fed hollow profile strip 53 and/or the section 73 of the partially completed spacer frame is deflected from the bending plane or the front end 72 of the introduced hollow profile strip 53 is simply moved in the downward direction so that the fourth bending operation is not impeded.

After the fourth bending step is finished, the spacer frame, completed except for joining the two ends of the hollow profile strip 53 adjoining at the butt joint 71 (FIG. 9*f*), is transported out of the apparatus after the jaws 3 and 4 have been released again.

The ends of the hollow profile strip bent into the spacer frame which adjoin each other at the junction point 71 are connected, for example, by the insertion of a connector or by butt-welding of these ends. A welding device suited for this purpose is known, for example, from EP-A-0,192,921.

An especially advantageous embodiment of a gripper 52 ensuring the required frictional contact for the accurate feed of the hollow profile strip 53 is illustrated in FIG. 10. It can be seen that the lower jaw 76 is rigidly connected to the slide 51 guided in the conveying direction on at least one guide rail (not shown) whereas the upper jaw 72 can be swung away form the jaw 76 by way of parallelogram guide arms 73 by means of a pressure medium motor 74. The movable jaw 72 can be swung to behind the supporting wall 60 of the apparatus so that it does not interfere with the transporting away of a spacer frame that has finished its bending process.

What is claimed is:

1. In a process for bending hollow profile strips into spacer frames for insulating glass panes wherein the hollow profile strip is moved stepwise to a bending station and bent after each feeding step; advancing the hollow profile strip by a feeding device by which the hollow profiled strip is clamped; retaining the hollow profile strip prior to the bending step in the zone of the bend to be produced in the bending station; then bending the hollow profile strip; severing the hollow profile strip, prior to bending of the final corner, from the introduced hollow profile strip after it has been advanced for the last time; and then bending the final corner and transporting away the thus-produced spacer frame; the improvement wherein the advancement of the hollow profile strip prior to bending of the first corner is less by a predetermined increment (x) than the dimension of the spacer frame to be manufactured, measured in this direction; and the hollow profile strip, prior to the final bending step, is severed from the introduced hollow profile strip at a spacing from the bending station corresponding to the length of the predetermined increment (x), whereby the spacer frame thus produced has a side extending in said direction which is comprised by two aligned portions with a butt joint between them, that have been produced by the first and the final bending steps.

2. Process according to claim 1, wherein, during bending of the final corner, the previously bent section of the hollow profile strip and/or the forward end of the introduced hollow profile strip is deflected from the bending plane.

3. Process according to claim 1, wherein the bent sections of the hollow profile strip rest on a supporting surface.

4. Process according to claim 1, wherein the hollow profile strip is retained in the region of the bending station during movement of the feeding device into its starting position.

5. In apparatus for bending hollow profile strips into spacer frames for insulating glass frames, comprising a device for feeding the hollow profile strip to be bent into the spacer frame, a supporting surface for the bent sections of the hollow profile strip, and a bending head; the device (1) for feeding the hollow profile strip including a gripper (52) which can be brought into contact with the hollow profile strip (53) during the advancement of the hollow profile strip (53), and the bending head has jaws (3, 4) which can be brought into contact with the hollow profile strip (53), for retaining the hollow profile strip (53) during the bending operations, the gripper (52) and the jaws (3, 4) alternatingly engaging the hollow profile strip (53); the improvement wherein the apparatus further comprises a clamp (2) for the hollow profile strip (53) having two clamping jaws (3, 4) movable relative to each other for varying their mutual distance, these jaws being capable of contacting the lateral surfaces (40) of the hollow profile strip (53) to be bent, a support (6) for the hollow profile strip (53) to be bent between the clamping jaws (3, 4), an abutment (20) associated with the clamp (2), about which the hollow profile strip (53) is bent, this abutment being in contact, during the bending step, with the surface of the hollow profile strip (53) subsequently forming the inner corner, and a bending lever (50) pivotable with respect to the clamp (2) for performing the bending operation, this bending lever being capable of contacting the section of the hollow profile strip (53) projecting past the clamp (2), the abutment (20) being retained on a support (21) which latter is adjustable in and, respectively, in parallel to the plane of symmetry of the clamp (2), as well as also perpendicularly to this plane of symmetry for moving the abutment out of the bending plane.

6. Apparatus according to claim 5, wherein the support (21) for the abutment (20) is pivotable about an axis (bearing 26) perpendicular to the plane of symmetry of the clamp (2).

7. Apparatus according to claim 5, wherein the support (21) for the abutment (20) is displaceably guided in a holder (31) perpendicularly to the plane of symmetry of the clamp (2).

8. Apparatus according to claim 5, wherein the support (21) for the abutment (20) is mounted on a lever (25) which latter is supported on the apparatus to be pivotable about an axis perpendicular to the plane of symmetry of the clamp (2).

9. Apparatus according to claim 5, wherein the support (21) for the abutment (20) is guided in a holder (31) attached to the lever (25) to be displaceable perpendicularly to the plane of symmetry of the clamp (2) by way of at least two guide members (30).

10. Apparatus according to claim 5, wherein the abutment (20) is mounted on its support (21) in an exchangeable fashion.

11. Apparatus according to claim 10, wherein the abutment (20) is carried by the support (21) in a groove

(23) provided in the support (21), with a sliding fit, and is fixed with the aid of a mounting device (24).

12. Apparatus according to claim 5, wherein one of the clamping jaws (3) of the clamp (2) is fixedly attached to the frame of the apparatus, and the second clamping jaw (4) is guided in a displaceable fashion with respect to the fixed clamping jaw (3).

13. Apparatus according to claim 5, wherein, for guiding the movable clamping jaw (4) with respect to the fixed clamping jaw (3), guide rods (5, 6) aligned perpendicularly to the plane of symmetry of the clamp (2) are provided which engage in bores in one of the clamping jaws (3, 4) with a sliding fit, said guide rods (6) simultaneously constituting a bearing for the hollow profile strip to be bent.

14. Apparatus according to claim 13, wherein the movable clamping jaw (4) is coupled, by way of a lever (8)–tie rod (9) drive mechanism, with a linear motor.

15. Apparatus according to claim 5, wherein one of the clamping jaws (3, 4) of the clamp (2) has a step (42) on its side facing the abutment (20), and the abutment (20) has a counter surface (41) engaging in the step (42) when the abutment (20) is in the operative position.

16. Apparatus according to claim 5, wherein the abutment (20) is narrower than the hollow profile strip (53) to be bent and has at its free end a bead-like thickened portion (35).

17. Apparatus according to claim 5, wherein the bending lever (50) is pivotable about an axis (37) perpendicular to the plane of symmetry of the clamp (2), this axis being coaxial with the axis of the bead (35) at the front end of the abutment (20) when the abutment (20) is in its operative position.

18. Apparatus according to claim 7, wherein the pivot axis (bearing 26) of the lever (25) carrying the support (21) for the abutment (20) is offset with respect to the pivot axis (37) for the bending lever (50).

19. Apparatus according to claim 5, further comprising a bending device (58, 59) and a conveying device (54) for transporting the hollow profile strip (53), and a gripper (52) which can be fixedly attached to the hollow profile strip (53) and which is displaceable by a pre-selectable distance in parallel to the conveying device (54).

20. Apparatus according to claim 19, wherein the gripper (52) is disposed on a slide (51) which is displaceable on a guide means extending in parallel to the conveying device (54).

21. Apparatus according to claim 19, further comprising a path measuring device (56) associated with the drive motor (55) for the slide (51).

22. Apparatus according to claim 19, wherein the slide (51) is coupled with an endless toothed belt driven by the drive motor (55).

23. Apparatus according to claim 19, wherein the drive motor (55) is mounted on the slide (51) and has a pinion meshing with a rack fixedly mounted on the apparatus.

24. Apparatus according to claim 19, further comprising a stop (57) at the bending station (58/59), this stop being lowerable at least as low as the conveying route (conveying device 54).

25. Apparatus according to claim 5, wherein the gripper (52) has jaws (72, 76) which can be brought into contact with the hollow profile strip (53) from the top and from the bottom.

26. Apparatus according to claim 25, wherein the lower jaw (76) of the gripper (52) is fixedly mounted on the slide (51), and the upper jaw (72) of the gripper (52) is movable mounted on the slide (51).

27. Apparatus according to claim 26, wherein the movable jaw (72) is connected to the slide (51) by way of parallelogram guide arms (73).

* * * * *